US008522510B2

(12) United States Patent
Elliott et al.

(10) Patent No.: US 8,522,510 B2
(45) Date of Patent: Sep. 3, 2013

(54) LAMINATED STARTER SHINGLE FOR A ROOF COVERING

(75) Inventors: Bert W. Elliott, Westerville, OH (US); David E. Pap, Santa Monica, CA (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 2757 days.

(21) Appl. No.: 10/664,552

(22) Filed: Sep. 18, 2003

(65) Prior Publication Data

US 2005/0072109 A1 Apr. 7, 2005

(51) Int. Cl.
*E04D 1/00* (2006.01)
*E04B 7/00* (2006.01)

(52) U.S. Cl.
USPC ..... 52/748.1; 52/746.11; 52/747.1; 52/554; 52/557

(58) Field of Classification Search
USPC ..... 52/518, 543, 554, 555, 557, 748.1, 52/746.11, 747.1
See application file for complete search history.

(56) References Cited

U.S. PATENT DOCUMENTS 1,765,197 A 6/1930 Batcheller
2,129,288 A 9/1938 Shattuck
2,200,341 A * 5/1940 Rahr ..... 52/316
3,763,609 A * 10/1973 Probst ..... 52/105
3,998,685 A 12/1976 Czyzewski et al.
4,148,168 A * 4/1979 Diamond ..... 52/748.1
4,418,505 A 12/1983 Thompson
4,637,191 A * 1/1987 Smith ..... 52/748.1
4,992,315 A 2/1991 Zickell et al.
5,099,627 A * 3/1992 Coulton et al. ..... 52/408
5,102,487 A 4/1992 Lamb
5,181,361 A * 1/1993 Hannah et al. ..... 52/535
5,405,647 A 4/1995 Grubka et al.
5,599,581 A 2/1997 Burton et al.
5,666,776 A * 9/1997 Weaver et al. ..... 52/557
5,853,858 A * 12/1998 Bondoc ..... 428/195.1
6,010,589 A 1/2000 Stahl et al.
6,014,847 A * 1/2000 Phillips ..... 52/311.1
6,038,827 A * 3/2000 Sieling ..... 52/557
6,067,766 A * 5/2000 Badke ..... 52/518
6,148,578 A * 11/2000 Nowacek et al. ..... 52/518
6,174,403 B1 * 1/2001 Steiner et al. ..... 156/260
6,190,754 B1 * 2/2001 Bondoc et al. ..... 428/143
6,220,329 B1 * 4/2001 King et al. ..... 156/512
6,235,142 B1 5/2001 Koschitzky
6,289,648 B1 * 9/2001 Freshwater et al. ..... 52/557
6,355,132 B1 * 3/2002 Becker et al. ..... 156/260
6,457,290 B1 * 10/2002 Elliott ..... 52/557
6,510,664 B2 * 1/2003 Kupczyk ..... 52/528

(Continued)

*Primary Examiner* — Jeanette E. Chapman
(74) *Attorney, Agent, or Firm* — Calfee, Halter & Griswold LLP

(57) ABSTRACT

A method of covering a roof deck includes laying a course of starter shingles in a side-by-side relationship at an eave edge of a roof deck. A starter shingle of the course of starter shingles is a laminated starter shingle comprising an underlay sheet laminated below an overlay sheet. A plurality of successive generally horizontal courses of covering shingles are laid above the course of starter shingles. The covering shingles in each of the courses of covering shingles are laid in a side-by-side relationship and horizontally offset from the covering shingles in adjacent courses. Each covering shingle of the courses of covering shingles includes a headlap portion and a butt portion. The butt portion includes a plurality of tabs separated by cutouts. The starter shingles include an exposed portion extending between the tabs of the covering shingles.

16 Claims, 4 Drawing Sheets

(56) References Cited

U.S. PATENT DOCUMENTS 6,526,717 B2 * 3/2003 Waggoner et al. ..... 52/554
6,679,308 B2 * 1/2004 Becker et al. ..... 156/512
6,691,489 B2 * 2/2004 Frame ..... 52/748.1
6,773,526 B2 * 8/2004 Phillips et al. ..... 156/71
6,790,307 B2 * 9/2004 Elliott ..... 156/260
2002/0033225 A1 3/2002 Becker et al.

* cited by examiner

LAMINATED STARTER SHINGLE FOR A ROOF COVERING

TECHNICAL FIELD

This invention relates in general to roof coverings, and in particular to roof coverings including roofing starter shingles.

BACKGROUND OF THE INVENTION

In the past, roofing shingles have had to satisfy two main functions when applied to a roof deck. The first function is to provide a durable, weatherproof covering for the roof deck. Roof shingles, whatever their form, are intended to provide a means of sheltering the structure below the shingles from precipitation and the deleterious effects of sun and wind. Roof shingles installed on the roof deck must perform these protecting functions for a reasonable period of time. The second function is to present an aesthetically pleasing architectural feature which enhances the overall appeal of the structure to which the shingles have been applied. This aesthetic function has been satisfied by providing asphalt shingles with various butt edge contours and surface treatments which operate to simulate more traditional, and in most cases more expensive, forms of roof coverings, such as, thatch, wooden shakes, slates, and even tiles of various forms.

An aesthetically pleasing shingle is a tab and cutout laminated shingle having a headlap portion and a tab portion including tabs and cutouts. Both the tabs and the cutouts are relatively wide, and the width of the tabs and the cutouts can vary. The area of the tabs is roughly equal to the area of the cutouts so that the two shingles can be simultaneously manufactured by cutting a common tab portion of a continuously moving granule covered sheet. The tabs and cutouts that are complementary so that the cutouts and tabs of one side of the common tab portion match the tabs and cutouts, respectively, of the other side of the common tab portion. An example of this is shown in U.S. Pat. No. 5,102,487 to Lamb, which is hereby incorporated by reference in its entirety. Improvements in the design of these wide tab, wide cutout shingles include contrasting coloration between the tabbed overlay and the portions of the underlay that show through the cutouts, and the use of shadow lines to enhance the perception of depth or thickness of the shingle.

Such tab and cutout laminated shingles typically require the use of starter shingles. Starter shingles are those shingles applied in a first course along the lower or eave edge of a roof deck before the commencement of the application of standard shingles in the usual manner. The starter shingles have the function of preventing leakage of water through the cutouts of the first course of standard shingles to the roof deck below. The cutout portions of standard shingles are oriented upwardly from the lower edge of the shingle. The cutouts of the shingles of all courses above the first course lie above uninterrupted portions of the next lower course of shingles, so that water leakage therethrough to the roof deck cannot occur, but the cutouts of the first course provide direct access for water to the deck. Therefore it is necessary to provide a course of starter shingles beneath the first course of standard shingles. The starter shingles must be uninterrupted and free of tabs or slots.

In addition, asphalt shingle roofs commonly include a minimum of two layers of shingle material at all locations on the roof. A starter shingle provides an additional layer of protection beneath the first course of standard shingles where there is no headlap from a lower course. For standard shingles with cutouts extending through all layers thereof, two layers of a starter shingle must be used to provide protection between the tabs in the course of standard shingles above. Commonly, the shingle installer must install two pieces of starter shingle, one piece at a time, and make sure the top piece is color matched to the field of the roof and that sealant is positioned to adhere the starter shingle to the roof so that nails are not visible.

Commonly, starter shingles can be provided by standard shingles, reversed front edge to rear edge from the usual position, so that the tab and cutout portions thereof project upwardly from the roof edge, and the headlap portion lies flush with the eave edge. Alternately, one or more layers of a starter material can be cut and applied to the roof deck prior to application of the first course of standard shingles. Another method of providing starter shingles involves cutting off the tabbed portion of a tabbed shingle, and applying the remaining portion to the roof deck prior to application of the first course of standard shingles. However, these methods require the shingle installer to expend undesirable time and effort to fabricate starter shingles.

SUMMARY OF THE INVENTION

This invention relates to an improved method of covering a roof deck. The method includes laying a course of starter shingles in a side-by-side relationship at an eave edge of a roof deck. A starter shingle of the course of starter shingles is a laminated starter shingle comprising an underlay sheet laminated below an overlay sheet. A plurality of successive generally horizontal courses of covering shingles are laid above the course of starter shingles. The covering shingles in each of the courses of covering shingles are laid in a side-by-side relationship and horizontally offset from the covering shingles in adjacent courses. Each covering shingle of the courses of covering shingles includes a headlap portion and a butt portion. The butt portion includes a plurality of tabs separated by cutouts. The starter shingles include an exposed portion extending between the tabs of the covering shingles.

The present invention also relates to a roof covering including a course of starter shingles laid in a side-by-side relationship at an eave edge of a roof deck. A starter shingle of the course of starter shingles is a laminated starter shingle including an underlay sheet laminated below an overlay sheet. A plurality of successive generally horizontal courses of covering shingles is laid above the course of starter shingles. The covering shingles in each of the courses of covering shingles are laid in a side-by-side relationship and vertically offset from the covering shingles in adjacent courses. Each covering shingle of the courses of covering shingles includes a headlap portion and butt portion. The butt portion includes a plurality of tabs separated by cutouts. The starter shingles include an exposed portion visible between the tabs of the covering shingles.

Various objects and advantages of this invention will become apparent to those skilled in the art from the following detailed description of the preferred embodiment, when read in light of the accompanying drawings.

DETAILED DESCRIPTION OF THE INVENTION

Figure 1:
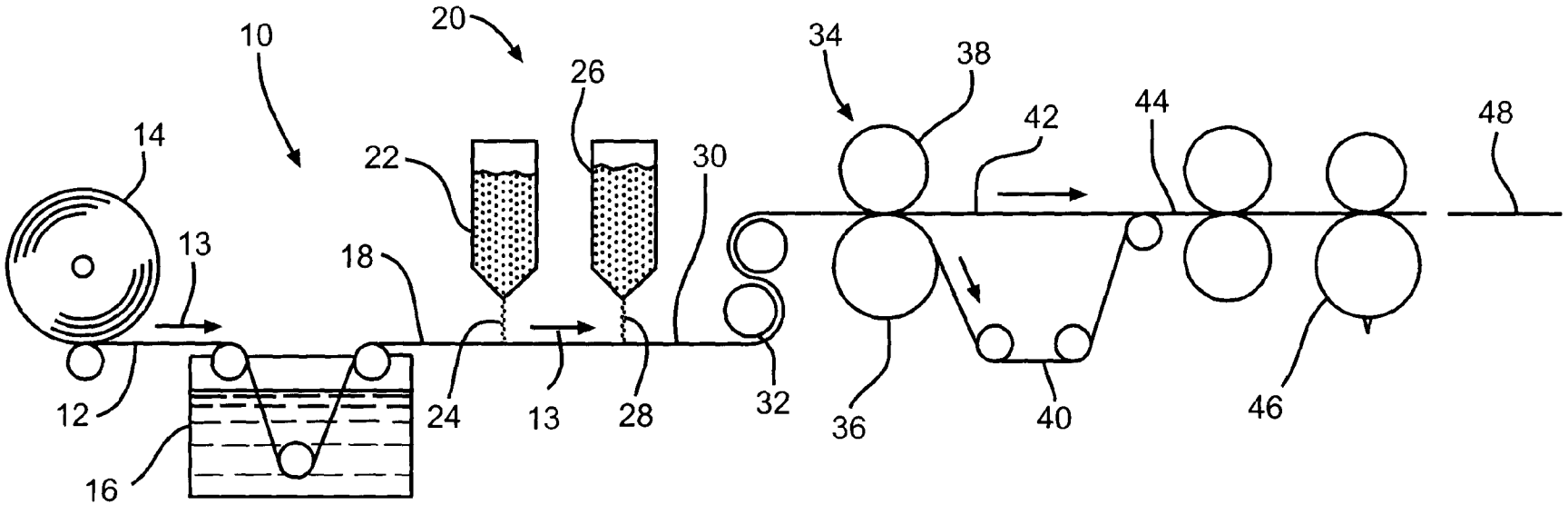
FIG. 1 is a schematic elevational view of an apparatus for making starter shingles according to the invention.
Figure 2:
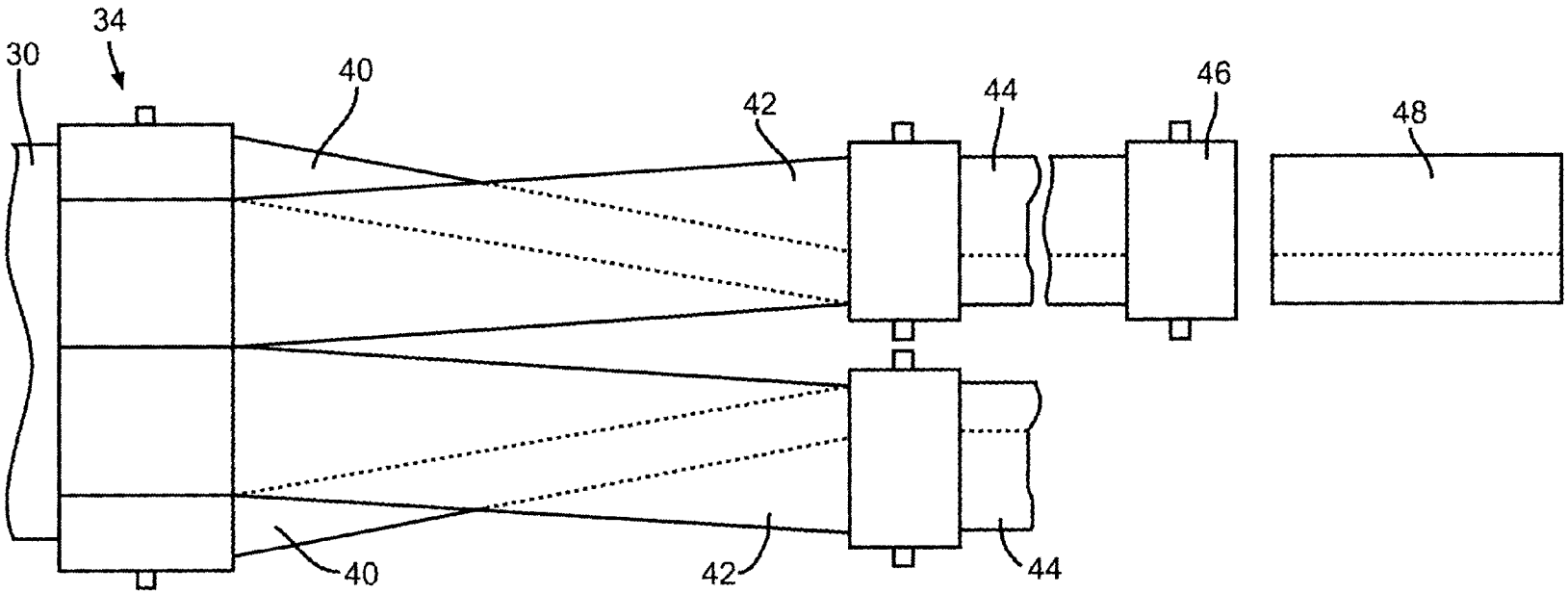
FIG. 2 is a plan view of a portion of the apparatus illustrated in FIG. 1, showing the laminating of the starter shingle underlay beneath the starter shingle overlay to make a single laminated sheet.

Referring now to the drawings, there is shown in FIGS. 1 and 2 an apparatus 10 for manufacturing an asphalt-based roofing material according to the invention. The illustrated manufacturing process involves passing a continuous sheet 12 in a machine direction (indicated by the arrows 13) through a series of manufacturing operations. The sheet usually moves at a speed of at least about 200 feet/minute (61 meters/minute), and typically at a speed within the range of between about 450 feet/minute (137 meters/minute) and about 800 feet/minute (244 meters/minute).

In a first step of the manufacturing process, a continuous sheet of substrate or shingle mat 12 is payed out from a roll 14. The substrate can be any type known for use in reinforcing asphalt-based roofing materials, such as a nonwoven web of glass fibers. The shingle mat 12 is fed through a coater 16 where a coating of asphalt is applied to the sheet. The asphalt coating can be applied in any suitable manner. In the illustrated embodiment, the sheet is submerged in a supply of hot, melted asphalt coating to completely cover the sheet with the tacky coating. However, in other embodiments, the asphalt coating could be sprayed on, rolled on, or applied to the sheet by other means. Typically the asphalt material is highly filled with a ground stone filler material, amounting to at least about 60 percent by weight of the asphalt/filler combination.

The resulting asphalt-coated sheet 18 is then passed beneath a series of granule dispensers 20 for the application of granules to the upper surface of the asphalt-coated sheet. The granule dispensers can be of any type suitable for depositing granules onto the granule covered sheet. A preferred granule dispenser is a granule blender of the type disclosed in U.S. Pat. No. 5,599,581 to Burton et al., which is hereby incorporated by reference, in its entirety. Although two granule dispensers are shown in the exemplary embodiment illustrated in FIG. 1, any suitable number and configuration of granule dispensers can be used. For example, the granule blender 22 can be used to deposit accent color granules 24 on the asphalt-coated sheet 18, and the granule blender 26 can be used to apply background granules 28, thereby defining a granule covered sheet 30. A preferred technique for assuring a generally sharp demarcation between zones of different colors is disclosed in U.S. Pat. No. 5,405,647 to Grubka et al., which is hereby incorporated by reference in its entirety.

After all the granules are deposited on the sheet 18, the granule covered sheet 30 is turned around a slate drum 32 to press the granules into the asphalt coating and to temporarily invert the sheet so that the excess granules will fall off and will be recovered and reused. The granule covered sheet 30 is subsequently fed through a rotary cutter 34 which includes a bladed cutting cylinder 36, and a backup roll 38, as shown in FIGS. 1 and 2.

Preferably, the cutter 34 cuts the granule covered sheet 30 into continuous underlay sheets 40 and continuous overlay sheets 42, as best shown in FIG. 2. Each continuous underlay sheet 40 is directed to be aligned beneath a continuous overlay sheet 42, and the two sheets are laminated together to form a continuous laminated sheet 44. As shown in FIG. 1, the continuous underlay sheet 40 is routed on a longer path than a path of the continuous overlay sheet 42. Further downstream the continuous laminated sheet 44 is passed into contact with a rotary shingle cutter 46 that cuts the laminated sheet 44 into individual laminated starter shingles 48. While FIG. 2 shows two shingles being made simultaneously, practice of the invention can involve making a single shingle, or making more than two shingles at one time.

Figure 3:
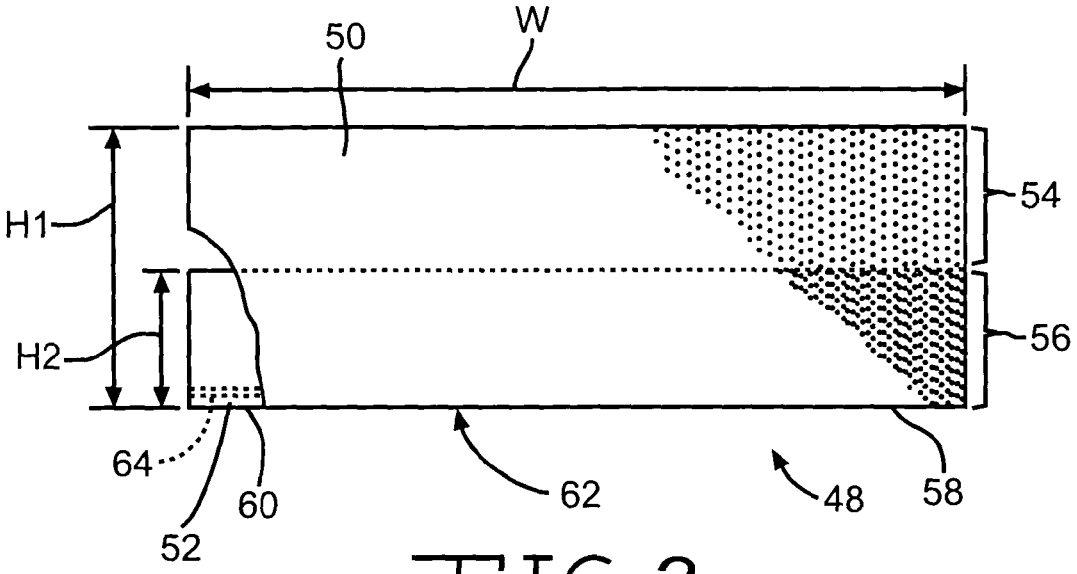
FIG. 3 is a plan view of the starter shingle illustrated in FIGS. 1 and 2.

As shown in FIG. 3, the starter shingle 48 formed by the process illustrated in FIGS. 1 and 2 includes an overlay sheet 50 and an underlay sheet 52. The overlay sheet 50 includes an upper or headlap portion 54 and a lower or butt portion 56. A rear surface of the overlay sheet 50 and a front surface of the underlay sheet 52 are fixedly attached to each other to form the laminated starter shingle 48. Such attachment can be accomplished by using adhesive materials applied to the rear surface of the overlay sheet 50 and the front surface of the underlay sheet 52. Preferably, a butt edge 58 of the butt portion 56 of the overlay sheet 50 and a lower edge 60 of the underlay sheet 52 are vertically aligned to define a lower edge 62 of the starter shingle 48. If desired, a bead of adhesive 64 can be applied to a bottom surface of the underlay sheet 52.

The starter shingle 48 is of a generally rectangular shape having a width W and an overall height H1. Preferably, the width W is about 40 inches, and the height H1 of the overlay sheet 50 is greater than a height H2 of the underlay sheet 52.

Figure 5:
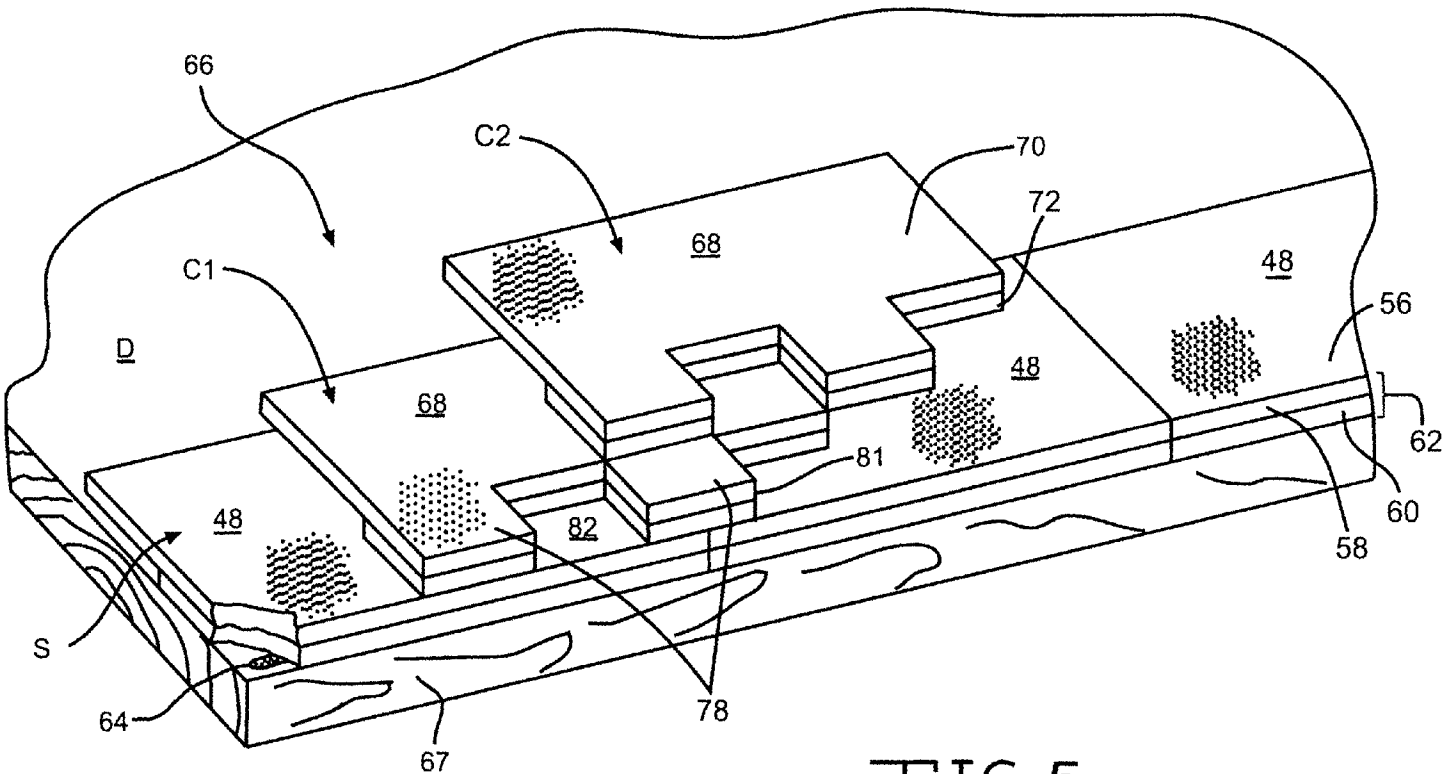
FIG. 5 is a perspective view of a portion of a roof deck covered with the starter shingles illustrated in FIGS. 1 through 3, and the covering shingles illustrated in FIG. 4.

Referring now to FIG. 5, there is illustrated a fragmentary view of a roof deck D having a roof covering 66. The roof covering 66 includes a plurality of the starter shingles 48. The starter shingles 48 are arranged in a course S of starter shingles 48 laid in a side-by-side relationship at an eave edge 67 of the roof deck D.

Covering shingles 68 are arranged in a series of successive generally horizontal courses, of which a portion of two such courses C1 and C2 are shown. The courses C1 and C2 are laid above the course S of starter shingles 48. The covering shingles 68 in each of the courses of covering shingles 68 are preferably laid in a side-by-side relationship and vertically offset from the covering shingles 68 in adjacent courses.

Figure 4:
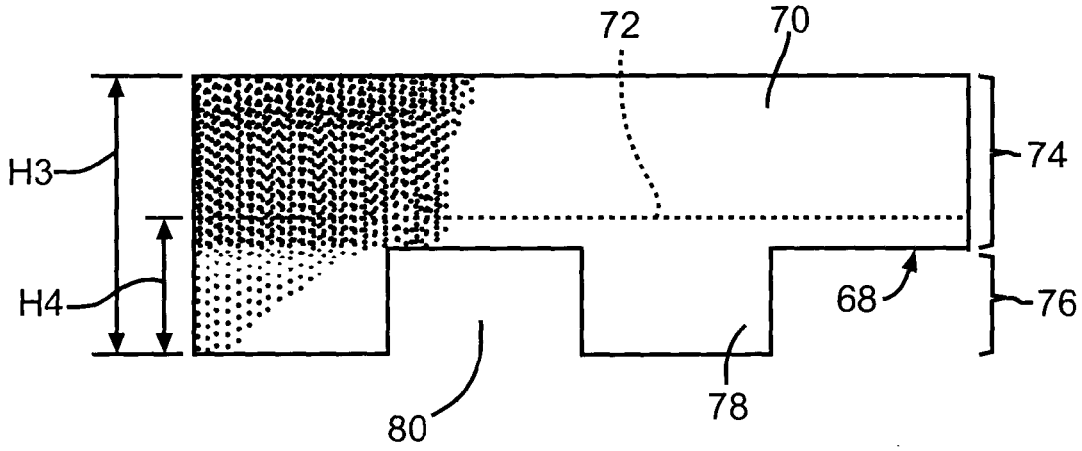
FIG. 4 is a plan view of a covering shingle for use in the roof covering according to the invention.

Preferably, as best shown in FIG. 4, each covering shingle 68 is a laminated shingle having an overlay member 70 and an underlay member 72. The overlay member 70 includes a headlap portion 74 and a butt portion 76. A rear surface of the overlay member 70 and a front surface of the underlay member 72 are fixedly attached to each other to form the covering shingle 68. The butt portion 76 of the covering shingle 68 preferably includes a plurality of tabs 78 separated by cutouts 80. Although illustrated as a two-layer laminated shingle, the covering shingle 68 can be any desired type of shingle, such as single layer shingle, or a laminated shingle having more than two layers.

A lower edge 81 of the covering shingles 68 in a first course C1 of the covering shingles 68 is preferably vertically aligned with the lower edge 62 of the starter shingles 48. When the course of starter shingles S is covered by such a course C1 of covering shingles 68, the starter shingles 48 include an exposed portion 82 visible between the tabs 78 of the covering shingles 68.

Preferably, the starter shingles 48 have a height H1 different from a height H3 of the covering shingles 68. More preferably, a difference between the height H1 of the starter shingles 48 and the height H3 of the covering shingles 68 is greater than about one inch. Such a difference in height prevents the occurrence of an undesirable raised portion or hump where upper edges of the course S and the first course meet, thereby improving the overall appearance of the roof covering 66.

Further, the underlay sheet 52 height H2 of each starter shingle 48 is different from a height H4 of the underlay member 72 of each covering shingle 68. More preferably, a difference between the underlay sheet 52 height H2 of each starter shingle 48 and the height H4 of the underlay member 72 of each covering shingle 68 is greater than about one inch.

For example, when used with a covering shingle having an underlay member height H4 of about 5 inches and an overall height H3 of about 14¼ inches, the starter shingle 48 preferably has an underlay height H2 of about 6⅝ inches and an overall height H1 of about 13¼ inches.

Preferably, the butt portions 56 of the starter shingles 48 have an overall color appearance that is substantially similar to an overall color appearance of the covering shingles 68, such that the exposed portions 82 of the starter shingles 48 will have an appearance similar to exposed portions 82 of the covering shingles 68 visible between the tabs 78 of the second and subsequent courses of the covering shingles 68 (i.e. course C2 and subsequent courses, not shown).

As is well known in the art, blend drops applied to the asphalt-coated sheet 18 are often made up of granules of several different colors. For example, one particular blend drop that is supposed to simulate a weathered wood appearance might actually consist of some brown granules, some dark gray granules, and some light gray granules. When these granules are mixed together and applied to the asphalt-sheet 18 in a generally uniformly mixed manner, the overall appearance of weathered wood is achieved. For this reason, the blend drops are referred to as having a color blend, which gives an overall color appearance, and this overall appearance may be different from any of the actual colors of the granules in the color blend. Also, blend drops of darker and lighter shades of the same color, such as, for example, dark gray and light gray, are referred to as different color blends rather than merely different shades of one color.

The principle and mode of operation of this invention have been described in its preferred embodiments. However, it should be noted that this invention may be practiced otherwise than as specifically illustrated and described without departing from its scope.

What is claimed is:

1. A method of covering a roof deck, the method comprising:

laying a course of starter shingles in a side-by-side relationship at an eave edge of a roof deck, wherein a starter shingle of the course of starter shingles is a laminated starter shingle comprising an underlay sheet laminated below an overlay sheet; and laying a plurality of successive generally horizontal courses of covering shingles above the course of starter shingles, the covering shingles in each of the courses of covering shingles being laid in a side-by-side relationship and horizontally offset from the covering shingles in adjacent courses, wherein each covering shingle of the courses of covering shingles includes a headlap portion and a butt portion, the butt portion including a plurality of tabs separated by cutouts, and wherein the starter shingles include an exposed portion extending between the tabs of the covering shingles, wherein a height of the overlay sheet is greater than a height of the underlay sheet.

2. The method according to claim 1, wherein the overlay sheet has a headlap portion and a butt portion, and wherein the underlay sheet is laminated beneath the butt portion of the overlay sheet.

3. The method according to claim 2, wherein the butt portion includes a butt edge and the underlay sheet includes a lower edge, and wherein the butt edge and the lower edge are vertically aligned to define a lower edge of the starter shingle.

4. The method according to claim 3, wherein a lower edge of the covering shingles in a first course of the covering shingles is vertically aligned with the lower edge of the starter shingles.

5. A laminated starter shingle comprising an underlay sheet laminated below an overlay sheet, the starter shingle used as part of a roof covering on a roof, the roof covering including a plurality of successive generally horizontal courses of covering shingles laid above a plurality of the starter shingles, the covering shingles in each of the courses of covering shingles being laid in a side-by-side relationship and vertically offset from the covering shingles in adjacent courses wherein the starter shingles include an exposed portion visible between the tabs of the covering shingles, wherein each covering shingle is a laminated covering shingle comprising an overlay member having a headlap portion and a butt portion and an underlay member fixedly attached to a rear surface of the butt portion of the overlay member, and wherein a difference between a height of the underlay sheet of each starter shingle and a height of the underlay member of each covering shingle is greater than about one inch.

6. The laminated starter shingle according to claim 5, wherein the underlay sheet is laminated beneath the butt portion of the overlay sheet, and wherein the butt portion includes a butt edge and the underlay sheet includes a lower edge, and wherein the butt edge and the lower edge are vertically aligned to define a lower edge of the starter shingle, and wherein a lower edge of the covering shingles in a first course of the covering shingles is vertically aligned with the lower edge of the starter shingles.

7. The laminated starter shingle according to claim 6, wherein the butt portions of the starter shingles have an overall color appearance that is substantially similar to an overall color appearance of the covering shingles.

8. A laminated starter shingle comprising an underlay sheet laminated below an overlay sheet, the starter shingle used as part of a roof covering on a roof , the roof covering including a plurality of successive generally horizontal courses of covering shingles laid above a plurality of the starter shingles, the covering shingles in each of the courses of covering shingles being laid in a side-by-side relationship and vertically offset from the covering shingles in adjacent courses, wherein each covering shingle of the courses of covering shingles includes a headlap portion and a butt portion, the butt portion including a plurality of tabs separated by cutouts, wherein the starter shingles include an exposed portion visible between the tabs of the covering shingles, and wherein a height of the overlay sheet is greater than a height of the underlay sheet.

9. The laminated starter shingle according to claim 8, wherein the underlay sheet is laminated beneath the butt portion of the overlay sheet, and wherein the butt portion includes a butt edge and the underlay sheet includes a lower edge, and wherein the butt edge and the lower edge are vertically aligned to define a lower edge of the starter shingle, and wherein a lower edge of the covering shingles in a first course of the covering shingles is vertically aligned with the lower edge of the starter shingles.

10. The laminated starter shingle according to claim 9, wherein the butt portions of the starter shingles have an overall color appearance that is substantially similar to an overall color appearance of the covering shingles.

11. A roof covering comprising:

a course of starter shingles laid in a side-by-side relationship at an eave edge of a roof deck, wherein a starter shingle of the course of starter shingles is a laminated starter shingle comprising an underlay sheet laminated below an overlay sheet; and a plurality of successive generally horizontal courses of covering shingles laid above the course of starter shingles, the covering shingles in each of the courses of covering shingles being laid in a side-by-side relationship and vertically offset from the covering shingles in adjacent courses, wherein each covering shingle of the courses of covering shingles includes a headlap portion and a butt portion, the butt portion including a plurality of tabs separated by cutouts, wherein the starter shingles include an exposed portion visible between the tabs of the covering shingles, wherein each covering shingle is a laminated covering shingle comprising:

an overlay member having a headlap portion and a butt portion; and an underlay member fixedly attached to a rear surface of the butt portion of the overlay member, and wherein a difference between a height of the underlay sheet of each starter shingle and a height of the underlay member of each covering shingle is greater than about one inch.

12. The roof covering according to claim 11, wherein the height of the overlay sheet is greater than the height of the underlay sheet.

13. The roof covering according to claim 11, wherein the underlay sheet is laminated beneath the butt portion of the overlay sheet.

14. The roof covering according to claim 13, wherein the butt portion includes a butt edge and the underlay sheet includes a lower edge, and wherein the butt edge and the lower edge are vertically aligned to defuse a lower edge of the starter shingle.

15. The roof covering according to claim 14, wherein a lower edge of the covering shingles in a first course of the covering shingles is vertically aligned with the lower edge of the starter shingles.

16. The roof covering according to claim 13, wherein the butt portions of the starter shingles have an overall color appearance that is substantially similar to an overall color appearance of the covering shingles.

* * * * *